US005163687A

United States Patent [19]

Jenkins

[11] Patent Number: 5,163,687

[45] Date of Patent: Nov. 17, 1992

[54] BASKETBALL FRANCHISE GAME APPARATUS

[76] Inventor: Meredith O. Jenkins, 3902 Oakside, Houston, Tex. 77053

[21] Appl. No.: 825,568

[22] Filed: Jan. 24, 1992

[51] Int. Cl.[5] ..... A63F 3/00

[52] U.S. Cl. ..... 273/277; 273/278

[58] Field of Search ..... 273/244, 247, 277, 278, 273/256, 259, 298

[56] References Cited

U.S. PATENT DOCUMENTS

| | | | |
|---|---|---|---|
| 4,010,957 | 3/1977 | Tricoli | 273/244 X |
| 4,027,882 | 6/1977 | Rosenburg | 273/247 |
| 4,486,022 | 12/1984 | Dixon | 273/244 X |
| 5,071,136 | 12/1991 | Lott | 273/259 |

FOREIGN PATENT DOCUMENTS

| | | | |
|---|---|---|---|
| 2051590 | 1/1981 | United Kingdom | 273/247 |

*Primary Examiner*—Paul E. Shapiro
*Assistant Examiner*—William E. Stoll
*Attorney, Agent, or Firm*—S. Michael Bender

[57] ABSTRACT

A game board to receive a plurality of decks of cards to include a deck of game cards and player cards, as well as draft cards, provided to direct game participants in selecting and establishing teams of various values and worth. Limits are placed upon such teams to be developed, with game cards utilized as directional cards to effect penalty and reward during the draft selection process. The game is arranged to further provide for a player board formed as a support board to position various player cards thereon, wherein the use of a player support plate and adhering player dollar plates are provided whereupon exceeding of a team dollar limit effects displacement of the player support plate from an associated team support hook.

4 Claims, 4 Drawing Sheets

FIG. 11
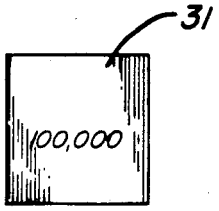
FIG. 12
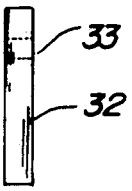
FIG. 13
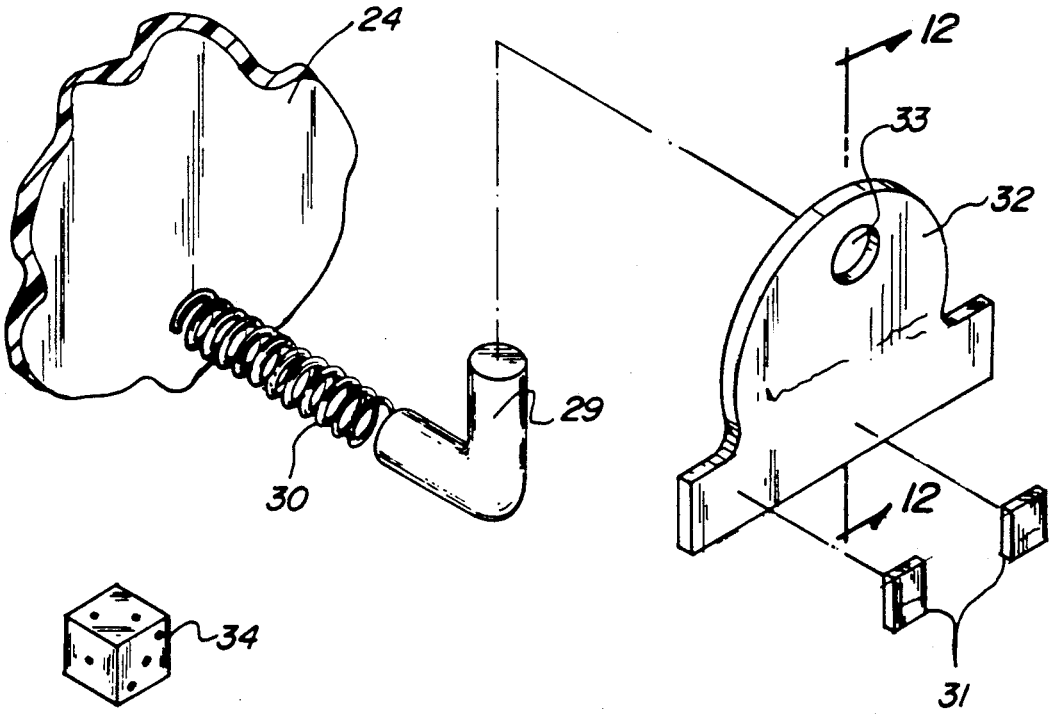
FIG. 3A

BASKETBALL FRANCHISE GAME APPARATUS

BACKGROUND OF THE INVENTION

1. Field of the Invention

The field of invention relates to game apparatus, and more particularly pertains to a new and improved basketball franchise game apparatus wherein the same is arranged to direct individual participants in play of the game to select a desirable basketball team.

2. Description of the Prior Art

Game apparatus of various types relative to sporting events are developed in the prior art for entertainment and amusement of individuals. Such games are exemplified in the U.S. Pat. No. 4,856,780 to Begley, et al. wherein a game is arranged to question individual players based on a sport trivia arrangement.

U.S. Pat. No. 3,895,798 to Collins sets forth a football simulation game, and U.S. Pat. No. 4,010,957 to Tricoli sets forth a game board representing various aspects of team sports.

As such, it may be appreciated that there continues to be a need for a new and improved basketball franchise game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of sports game apparatus now present in the prior art, the present invention provides a basketball franchise game apparatus wherein the same is arranged to direct individual players to construct a desirable basketball team based upon selection of various players. As such, the general purpose of the present invention, which will be described subsequently in greater detail, is to provide a new and improved basketball franchise game apparatus which has all the advantages of the prior art game apparatus and none of the disadvantages.

To attain this, the present invention provides a game board to receive a plurality of decks of cards to include a deck of game cards and player cards, as well as draft cards to direct game participants in selecting and establishing teams of various values and worth. Limits are placed upon such teams to be developed, with game cards utilized as directional cards to effect penalty and rewards during the draft selection process. The game is arranged to further provide for a player board formed as a support board to position various player cards thereon, wherein the use of a player support plate and adhering player dollar plates are provided whereupon exceeding of a team dollar limit effects displacement of the player support plate from an associated team support hook.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved basketball franchise game apparatus which has all the advantages of the prior art game apparatus and none of the disadvantages.

It is another object of the present invention to provide a new and improved basketball franchise game apparatus which may be easily and efficiently manufactured and marketed.

It is a further object of the present invention to provide a new and improved basketball franchise game apparatus which is of a durable and reliable construction.

An even further object of the present invention is to provide a new and improved basketball franchise game apparatus which is susceptible of a low cost of manufacture with regard to both materials and labor, and which accordingly is then susceptible of low prices of sale to the consuming public, thereby making such basketball franchise game apparatus economically available to the buying public.

Still yet another object of the present invention is to provide a new and improved basketball franchise game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3*a* is an example of a die member for use as a random numerical generator as exemplary thereof.

FIG. 11 is an orthographic frontal view of a player dollar plate utilized by the invention.

FIG. 12 is an orthographic view, taken along the lines 12—12 of FIG. 13 in the direction indicated by the arrows.

FIG. 13 is an isometric illustration of the ferrous support plate in association with the individual dollar plates.

DESCRIPTION OF THE PREFERRED EMBODIMENT

Figure 1:
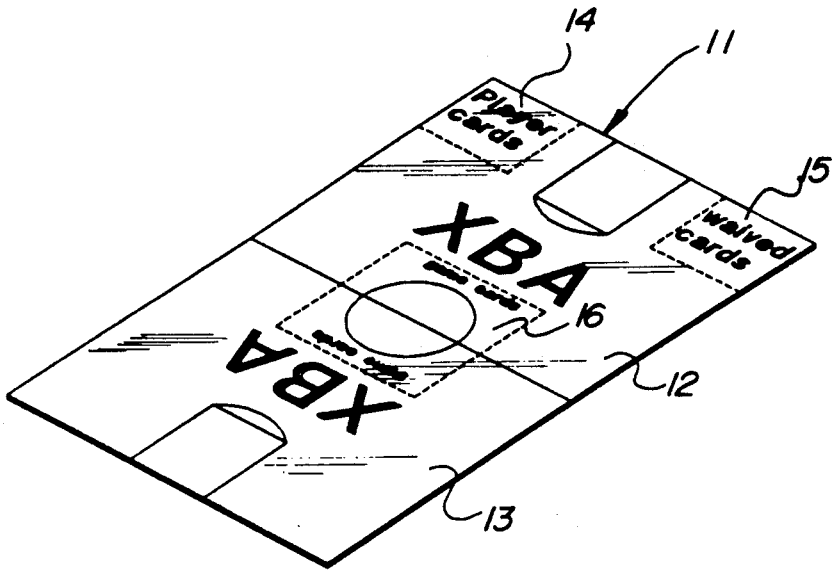
FIG. 1 is an isometric illustration of the game board of the invention.
Figure 2:
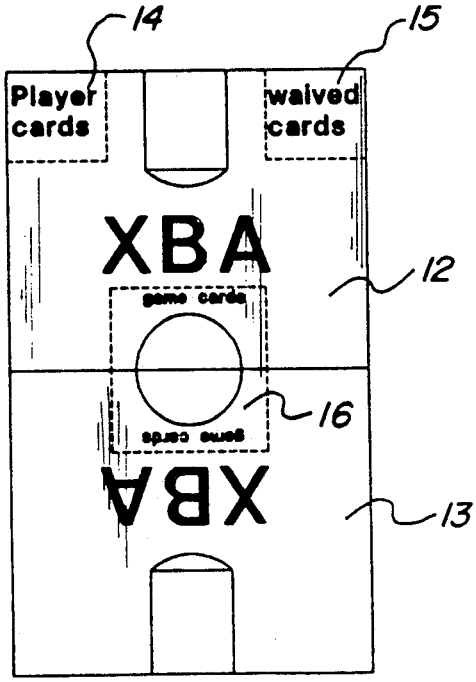
FIG. 2 is an orthographic top view of the game board.
Figure 3:
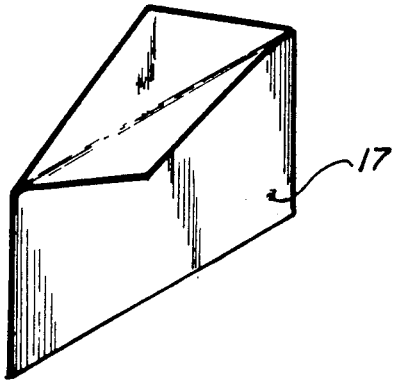
FIG. 3 is an isometric illustration of the individual player envelopes.
Figure 4:
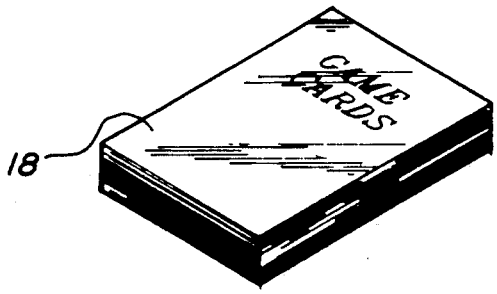
FIG. 4 is an isometric illustration of the game cards utilized by the invention.
Figure 5:
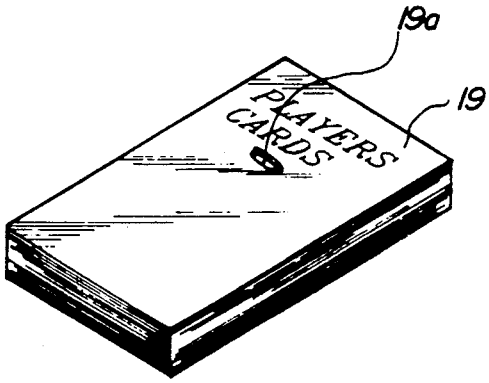
FIG. 5 is an isometric illustration of the player cards utilized by the invention.
Figure 6:
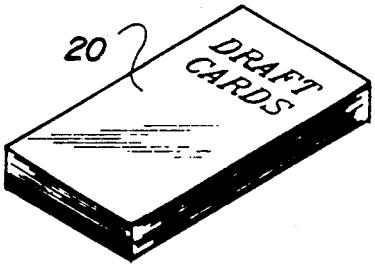
FIG. 6 is an isometric illustration of the draft cards utilized by the invention.

With reference now to the drawings, and in particular to FIGS. 1 to 13 thereof, a new and improved basketball franchise game apparatus embodying the principles and concepts of the present invention and generally designated by the reference numerals 11-34 will be described.

Figure 7:
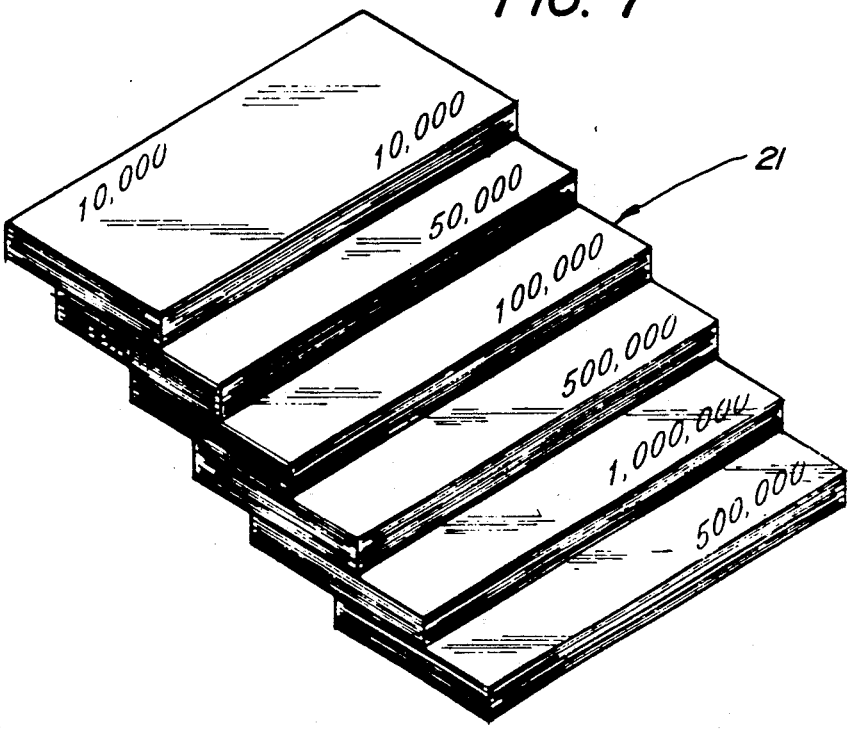
FIG. 7 is an isometric illustration of the token money afforded each participant.
Figure 8:
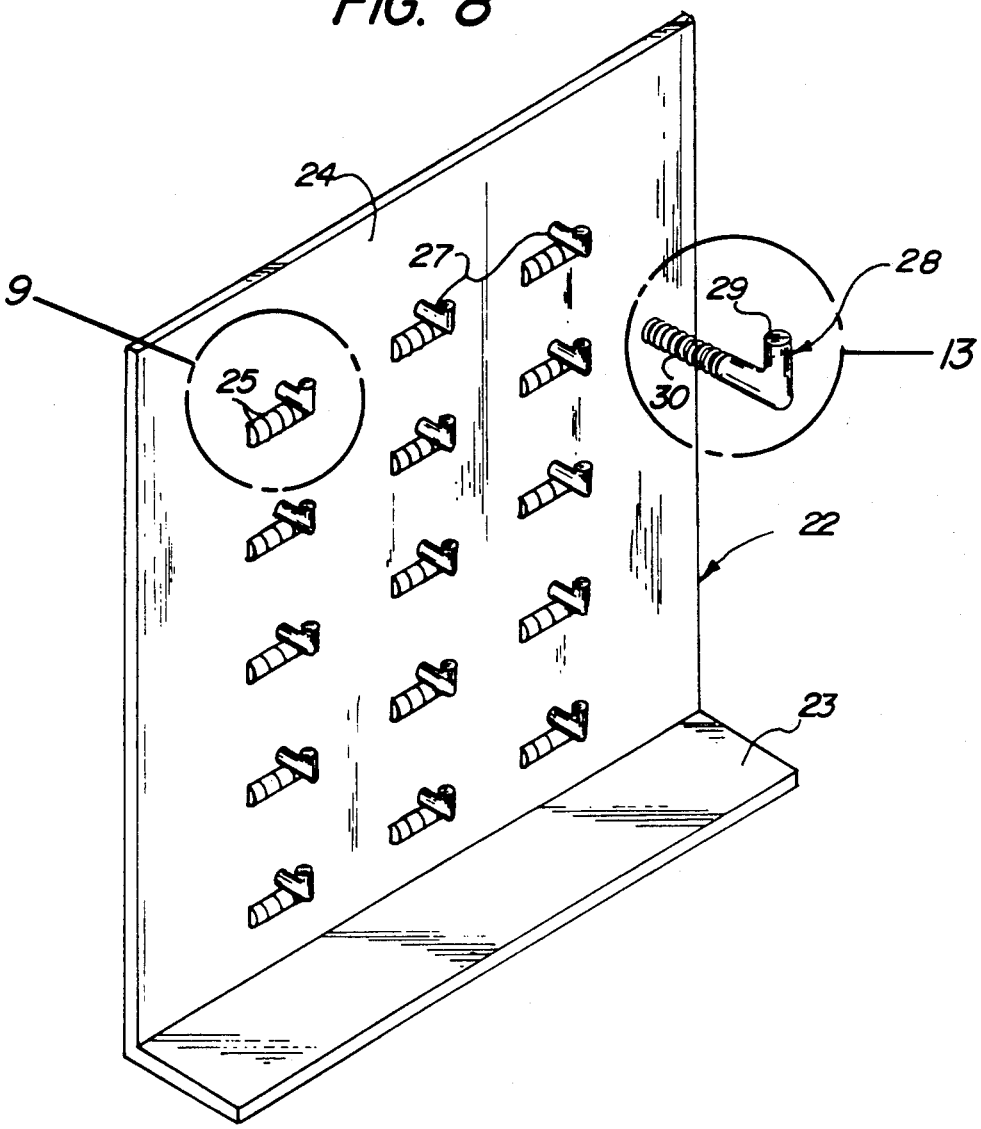
FIG. 8 is an isometric illustration of a team support board for optional use by the invention.
Figure 10:
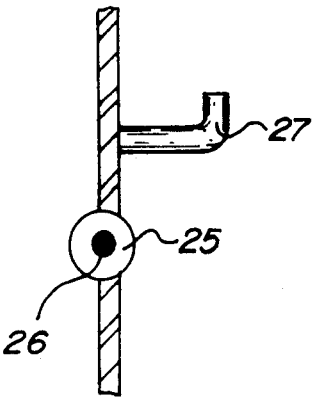
FIG. 10 is an orthographic view, taken along the lines 10—10 of FIG. 9 in the direction indicated by the arrows.
Figure 9:
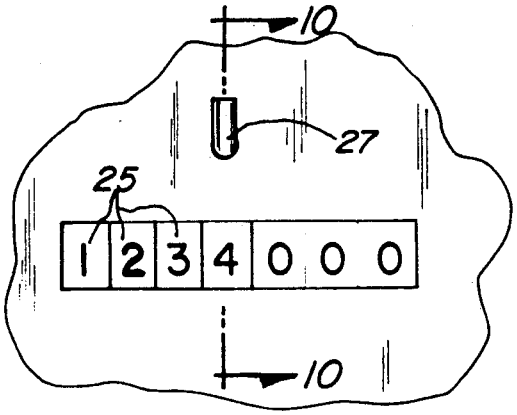
FIG. 9 is an orthographic view of section 9 as set forth in FIG. 8.

The game apparatus of the invention includes a game board 11, including a top surface formed with a first space 12 and a second space 13 equally dividing the top surface of the game board 11. The first space 12 includes a respective third and fourth space 14 and 15. The third space 14 receives the deck of player cards 19. The fourth space 15 includes "waived cards", wherein such cards are a player card, wherein an owner chooses for any reason to be discarded from the team being assembled. A waive player represented by a player card of the deck 19 positioned on the fourth space 15 may not participate in a drafting procedure, to be discussed in more detail below, but is to be auctioned to a highest bidder of a plurality of participants playing the game of the invention. A moving participant who releases a player to the fifth space 16 may also be involved in the auctioning procedure. A fifth space 16 equally directed through the first and second spaces 12 and 13 receives game cards of a deck of game cards 18 (see FIG. 4), wherein such game cards are arranged as instructional cards, wherein the instructional cards are arranged to direct players and impart penalty or direction in play of the game. An example is such that 1) "You must choose a guard with this pick"; 2) "A chosen player has been suspended for shoving referee". Options include permit a suspension to take its course or pay $300,000.00 for reinstatement; 3) "Your number 4 pick has been banned for substance abuse". Such penalty and directional examples of the game cards permit various impediments and the like in a participating player in the game from assembling a chosen and desirable team. Each player is associated with an envelope member 17 of a type as exemplified in the FIG. 3, and initially each player is provided a predetermined quantity of money of token money 21, as illustrated in FIG. 7.

The draft cards 20 are directional cards in play of the game.

More specifically, the player cards 19 are set forth to include by way of example a picture of a given player, as well as a player's nickname and the like, and an associated team name. This configuration may be positioned on one side of such a player card 19, wherein a rear side of the player card for informant purposes may include a further picture of the player, as well as player statistics and associating a player with a predetermined nickname and the like. The player cards are directed to represent players associated with the "National Basketball Association" (R). The list is arranged to include:

| | |
|---|---|
| Guards | |
| Anthony (Spud) Webb | 250,000 |
| Isaiah Thomas | 1,200,000 |
| Earving (Magic) Johnson | 3,000,000 |
| Michael (Air) Jordan | 4,000,000 |
| Dale Ellis | 950,000 |
| Joe Dumara | 900,000 |
| Clyde Drexler | 1,000,000 |
| Kevin Johnson | 1,200,000 |
| John Stockton | 1,100,000 |
| Dennis Johnson | 500,000 |
| Vinnie Johnson | 600,000 |
| Maurice Cheeks | 650,000 |
| Rolando Blackmon | 950,000 |
| Mark Price | 850,000 |
| Mark Jackson | 700,000 |
| Ron Harper | 900,000 |
| Kevin Porter | 1,000,000 |
| Centers | |
| Brad Daughterty | 1,000,000 |
| Akeem (Dream) Olajuwon | 3,000,000 |
| Patrick Ewing | 2,500,000 |
| Moses Malone | 2,000,000 |
| David Robinson | 3,000,000 |
| Robert Parrish | 1,800,000 |
| Mark Eaton | 900,000 |
| Ronnie Seikaly | 750,000 |
| Forwards | |
| Mark Aquire | 900,000 |
| Kevin McHale | 1,600,000 |
| Karl (Mailman) Malone | 2,000,000 |
| Larry Bird | 3,200,000 |
| James Worthy | 1,500,000 |
| Bernard King | 800 000 |
| Charles Barkley | 2,500,000 |
| Tom Chambers | 1,400,000 |
| Dominique Wilkins | 2,000,000 |
| Charles Oakley | 1,200,000 |
| Scottie Pippen | 990,000 |
| John Sally | 900,000 |
| Terry Cummings | 1,100,000 |
| Alex English | 1,000,000 |
| Thurl Bailey | 850,000 |
| Horace Grant | 650,000 |
| Otis Thorpe | 1,200,000 |

It should be noted that the above noted selections of the "guards", "centers", and "forwards" are by way of example only and the list is contemplated to be of a greater extent only limited by active players, as well as inactive players, to be chosen relative to recognized players having participated in the game of basketball.

The draft cards 20 are arranged to include initial draft pick number, such as 1-6, a round number (such as to indicate which draft round the number is to be associated with such as round 1 round 2, etc.), and a draft selection number associated with a participant. Each participant is provided with a general manager designation that makes two selections per round for a total of ten selections when five draft rounds are to be utilized. In this manner, the order and selection of each player is thereby effected. In this manner, each participant receives only one draft card per the five rounds of play to be arbitrarily selected by the participants in the game. Prior to play of the game, a participating individual of the plurality of participants in the game is designed as a commissioner. This title directs that commissioner to oversee and referee the drafting procedure and resolve disputes. Initially, each participant is given by the director a predetermined quantity of money. For example, $20,000,000 in various denominations may be directed to each participant. Subsequently, the chosen commissioner places a draft card in an envelope to each member 17 to each player. The game cards and player cards are positioned upon the game board 11, as noted above.

The commissioner during play of the game may not be a competitor in order to preserve impartiality. Further, a salary cap is to be arbitrarily decided per each franchise team selected not to exceed a predetermined quantity such as $17,000,000 for example. The commissioner may serve as auctioneer for waived players, as well as free agents to be designated during play of the game. The commissioner levies off fines and oversees all player purchases and the like.

Initially, the player cards 19 are shuffled and positioned face-down upon the game board 11, wherein subsequently ten cards are selected and laid face-up on the game board, typically in the second space 13. The envelopes with the associated draft card therewithin to designate order of drafting is arbitrarily provided for each player. A random numerical generator of any particular type, such as a die member 34 as illustrated to FIG. 3*a*, may be awarded or of any various configuration to provide for change enumeration wherein the highest number thusly generated down to the lowest in that order is provided to each player, with the most propitious draft card awarded the highest total by the numerical generator.

A participant with a number one draft choice initiates the draft by choosing one of the ten players randomly selected and positioned upon the second space 13. A participant who drafted last in a first round is first to utilize a numerical generator for selection in a subsequent round.

It should be noted that a player lost to a team for any reason may not be recovered. To provide for a player to fill up a team of predetermined number of players, a replacement draft may be utilized to permit participants to select in a further round of drafting.

A player may be placed on waivers for any reason, as noted, with bidding to start for a waived player at $100,000 for example. Players that are released for free agency may not be drafted again but go to the highest bidder among other owners not to include the releasing owner as a participant. The releasing owner may exercise a "right of first refusal" by matching a highest bid to permit staying with the original participant of that player released for free agency.

Each team must have a minimum of three guards, two centers, three forwards, with maximum of four guards, three centers, and four forwards.

Salary cap: As noted a $17,000.000 salary cap is directed, but this is subject to arbitration by the participants in the game. Violators of exceeding the salary cap will be administered to effect a fine of $250,000 to each remaining participant and $500,000 to the commissioner. It is suggested that one-half of the fine thusly noted is refundable if salaries are brought in line with the salary cap selected.

Time out: Each participant is permitted three two-minute time-outs which may be used when it is that participating player's turn to draft. Such a time-out must be called attempting to negotiate with another participant regarding players. Owners or participants have ninety seconds to complete transactions to 1) read a game card; 2) announce a draft choice; and 3) pay for the associated player.

Penalties: $30,000 each. Such penalties may be assessed by the commissioner for the following; infractions to 1) attempt a negotiation without calling time or failure to follow the prescribed order or play. It should be noted that during play of the game the players may be traded, waived, bought and sold as required for each participant to fill a team. In a trade, the salary accompanies a player to a new team. In waiver, a salary goes at the bid that is initiated at $100,000. Further, a sale of a player from one participant to another effects that player's salary that accompanies that player of the player cards 19 to the new team. Unclaimed players may be picked up by any participant for $100,000to be indicated as a signing bonus and one-half of an original salary. A player resale is available involving selling players back to the league for one-half of the purchase price. A player thusly becomes a free agent with his salary as a starting bid. A participant that releases a player for resale does not enter the bidding but has the right of first refusal in this agency procedure. It should be noted further that a maximum of ten players may be drafted.

In suspension rules, a player may be placed by any participant on temporary waivers. A subsequent participant in drafting may be the only one that may bid on the released player. If that subsequent participant elects not to bid, that player returns to the releasing participant free and clear.

The FIGS. 8–13 illustrate the use of a team support board for use by the invention, wherein one is provided for each participant. The support board 22 includes a support board base 23 orthogonally mounted to the board for support thereof. A plurality of player support hooks 27 are orthogonally mounted projecting exteriorly of the surface 24. Underlying each player hook 27 is a plurality of totaling cylinders 25 that are coaxially aligned and relative displaceable relative to one another, with each cylinder including a numerical designation rotatable about an axle 26 that is individually directed through each of the groups of cylinders 25. The cylinders thereby provide for an expenditure total of a game card 19 that is to be directed upon the hook. In this manner, the player cards are provided with game card apertures 19*a* for positioning upon the hooks 27.

A team hook 28 is provided that includes a first leg 29 mounted to a second leg 30. The second leg 30 is of a spring construction, wherein the second leg 30 receives a ferrous player support plate 32 (see FIG. 13). Each player support plate is arranged to receive a single or plurality of the ferromagnetic player dollar plates. The dollar plates are of a numerical designation associated with an arbitrary dollar amount. In this manner, a team exceeding a salary cap by placing a number of the ferromagnetic player dollar plates on the player support plate effects displacement of the team hook 28 downwardly about the second leg spring member 30 for visual impact of exceeding a team total or salary cap.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A basketball franchise game apparatus, comprising, a game board, the game board including a top surface, the top surface demarcated into a first space and a second space, wherein the first space and the second space equally divide the game board top surface, the first space including a third space spaced from a fourth space, and a fifth space positioned medially within the first space and the second space, the third space including a deck of player cards positioned therewithin, and the second space arranged for receiving player cards discarded, and the fifth space including directional cards contained therewithin, and a plurality of envelopes, each envelope including a drafting card to indicate sequence of selection of said player cards by each participant, and each participant selecting a game card upon simultaneous selection with a player card.

2. An apparatus as set forth in claim 1 including each participant receiving a predetermined quantity of token money.

3. An apparatus as set forth in claim 2 wherein each participant is provided a team support board, the team support board including a board forward surface, and a board base orthogonally mounted to a lower end of the team support board, the forward surface including a plurality of player support hooks originating orthogonally and forwardly of the forward surface, and each player support hook includes a coaxially aligned series of adjacent totaling cylinders, each cylinder of said totaling cylinders includes numerical designations in association with a predetermined monetary quantity, and each player card of said player cards including a player card aperture directed therethrough to permit positioning of each player card upon one of said player support hooks.

4. An apparatus as set forth in claim 3 including a team hook, the team hook including a first leg fixedly mounted to a second leg, the second leg formed of a spring material, with the spring material directed into the forward surface in an orthogonal orientation, and a ferrous player support plate, the ferrous player support plate including a support plate aperture, and a plurality of ferromagnetic player monetary plates, each monetary plate is arranged in predetermined designated monetary quantities, whereupon positioning of a predetermined quantity of said monetary plates in magnetic adherence to the player support plate effects deflection of the second leg of the team hook for indication of exceeding a monetary team total limit.

* * * * *